US011613042B2

(12) United States Patent
Schnorr et al.

(10) Patent No.: US 11,613,042 B2
(45) Date of Patent: Mar. 28, 2023

(54) LOG SPLITTER INCLUDING A PUSHER ASSEMBLY

(71) Applicant: Multitek North America, LLC, Prentice, WI (US)

(72) Inventors: Daniel Schnorr, Rhinelander, WI (US); Douglas Kamps, Minocqua, WI (US)

(73) Assignee: Multitek North America, LLC, Prentice, WI (US)

( * ) Notice: Subject to any disclaimer, the term of this patent is extended or adjusted under 35 U.S.C. 154(b) by 197 days.

(21) Appl. No.: 16/983,039

(22) Filed: Aug. 3, 2020

(65) Prior Publication Data

US 2022/0032493 A1 Feb. 3, 2022

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06
See application file for complete search history.

(56) References Cited

U.S. PATENT DOCUMENTS 7,104,296 B2 9/2006 Heikkinen
9,840,022 B2 * 12/2017 Rodler ..... B27L 7/06

* cited by examiner

*Primary Examiner* — Matthew Katcoff
(74) *Attorney, Agent, or Firm* — Andrus Intellectual Property Law, LLP

(57) ABSTRACT

A pusher assembly for a log splitter can include a frame, an actuator, and a wedge assembly with a first set of cutting blades and a second set of cutting blades configured to split a log into a plurality of pieces. The pusher assembly includes a base configured to be coupled to the actuator, a plurality of push pads, and a plurality of support columns extending between each of the push pads and the base. The plurality of push pads may be spaced apart from the base, and each push pad may include a contact surface that is coplanar with the contact surfaces of the other push pads. The plurality of push pads are configured to receive the first set of cutting blades in gaps positioned between adjacent push pads as the plurality of push pads forces the log through the wedge assembly.

19 Claims, 10 Drawing Sheets

LOG SPLITTER INCLUDING A PUSHER ASSEMBLY

FIELD OF THE INVENTION

The present disclosure relates to log splitter systems, and in particular, to portable log splitter systems for splitting a log into a plurality of sections.

BACKGROUND

In some situations, it may be desirable to split logs into smaller pieces. This task can be done manually using a splitting maul or striking a wedge which splits the log, but both are labor intensive and require physical strength and endurance. Over the years, hydraulic cylinders have been used to push a section of log against a stationary simple wedge to split the log section into smaller pieces. Although numerous variations on the cutting wedge have been developed, nearly all are subject to plugging and binding when attempting to split the log section into many smaller pieces in a single pass through the cutting wedge.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One example of the present disclosure is of a pusher assembly for a log splitter, which can include a frame, an actuator, and a wedge assembly with a first set of cutting blades and a second set of cutting blades configured to split a log into a plurality of pieces. The pusher assembly may include a base configured to be coupled to the actuator and a plurality of push pads spaced apart from the base. Each of the push pads may include a contact surface that is coplanar with the contact surfaces of the other push pads. A plurality of support columns may extend between each one of the plurality push pads and the base. The plurality of push pads may be configured to receive the first set of cutting blades in gaps positioned between adjacent push pads as the plurality of push pads forces the log through the wedge assembly.

In some embodiments the plurality of push pads may include four push pads arranged in a two-by-two grid. The plurality of support columns may be arranged along interior edges of the push pads that extend along the gaps positioned between adjacent push pads. Additionally or alternatively, the plurality of push pads may be substantially identical to each other.

In some embodiments, each of the support columns may include a tine that extends through an opening formed through one of the plurality of push pads past the contact surface thereof, each of the tines beings configured to engage the log to be split. The plurality of support columns may be arranged so that debris can pass between the base and each one of the push pads. The plurality of support columns includes three support columns extending between each one of the push pads and the base.

In some embodiments, a support slide may be secured to the base and may be configured to slidably engage the frame to support the pusher assembly as it is moved by the actuator from a retracted position to an extended position to force the log through the wedge assembly. The pusher assembly may include a bushing configured to receive an end of the actuator to couple the base thereto. A shield may be incorporated to project outwardly from the base above the bushing, the shield being configured to protect the actuator for damage.

According to another example of the present disclosure, a log splitter may be configured to split a log into a plurality of log pieces. The log splitter may include a frame, a wedge assembly positioned at a first end of the frame, and a pusher assembly linked to a second end of the frame opposite the first end. The wedge assembly may include a first set of cutting blades and a second set of cutting blades positioned behind the first set of blades. The pusher assembly may include a plurality of push pads, and each one of the push pads may be supported by a plurality of support columns. The plurality of push pads may be configured to push the log through the wedge assembly as the pusher assembly moves into the extended position. Additionally or alternatively, the plurality of push pads may be configured to be received in the wedge assembly between the first set of cutting blades as the log is pushed through the wedge assembly.

In some embodiments, the wedge assembly includes a first wedge box with the first set of cutting blades and a second wedge box including the second set of cutting blades, and the frame includes a wedge bracket configured to receive the first wedge box and the second wedge box. The first set of cutting blades may be configured to divide a passageway through the wedge assembly into a plurality of first sections, and the second set of cutting blades may be configured to divide each one of the first sections into a plurality of second sections.

In some embodiments, the pusher assembly includes gaps positioned between each of the plurality of push pads, and the gaps may be configured to receive the first set of cutting blades as the plurality of push pads move into the wedge assembly. In such an embodiment, the first set of cutting blades may include a vertical blade and a horizontal blade arranged perpendicularly to the vertical blade, and the vertical blade and horizontal blade can intersect to define four quadrants. In this instance, the plurality of push pads may include four push pads, each one configured to be received in one of the four quadrants.

In some embodiments, each plurality of support columns may be configured to provide a space between one of the push pads and a base of the pusher assembly. Each plurality of support columns may include three support columns extending between one of the push pads and the base of the pusher assembly. Additionally or alternatively, the pusher assembly may include a support slide configured to slidably engage the frame to support the pusher assembly as it is moves from the retracted position to the extended position.

Various other features, objects, and advantages will be made apparent from the following description taken together with the drawings.

BRIEF DESCRIPTION OF THE DRAWINGS

The present disclosure is described with reference to the following Figures. Where possible, like numbers are used throughout the Figures to reference like features and like components.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements or machines from another.

Figure 1:
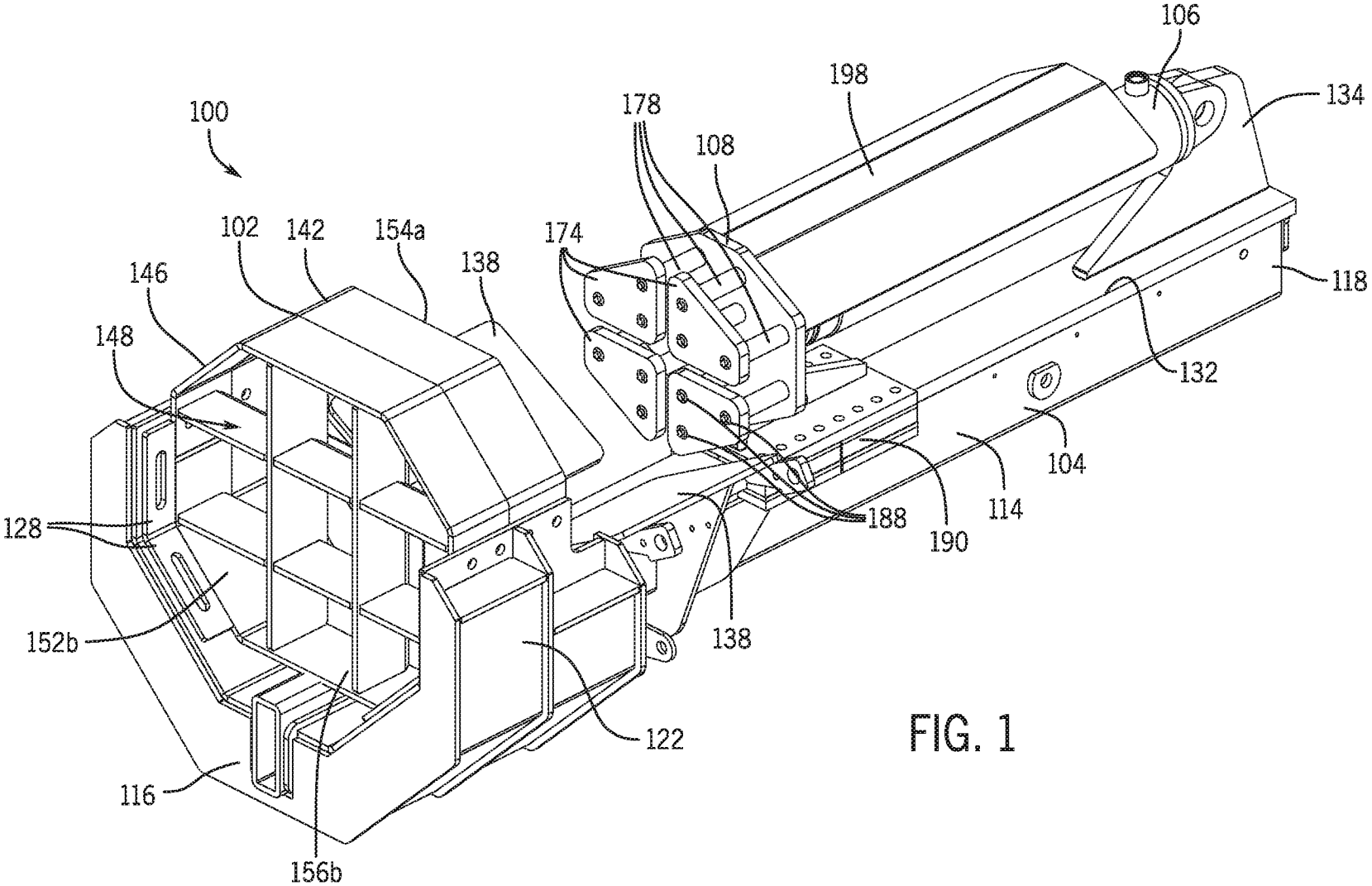
FIG. 1 is a perspective view of an embodiment of a log splitter with a pusher assembly.
Figure 2:
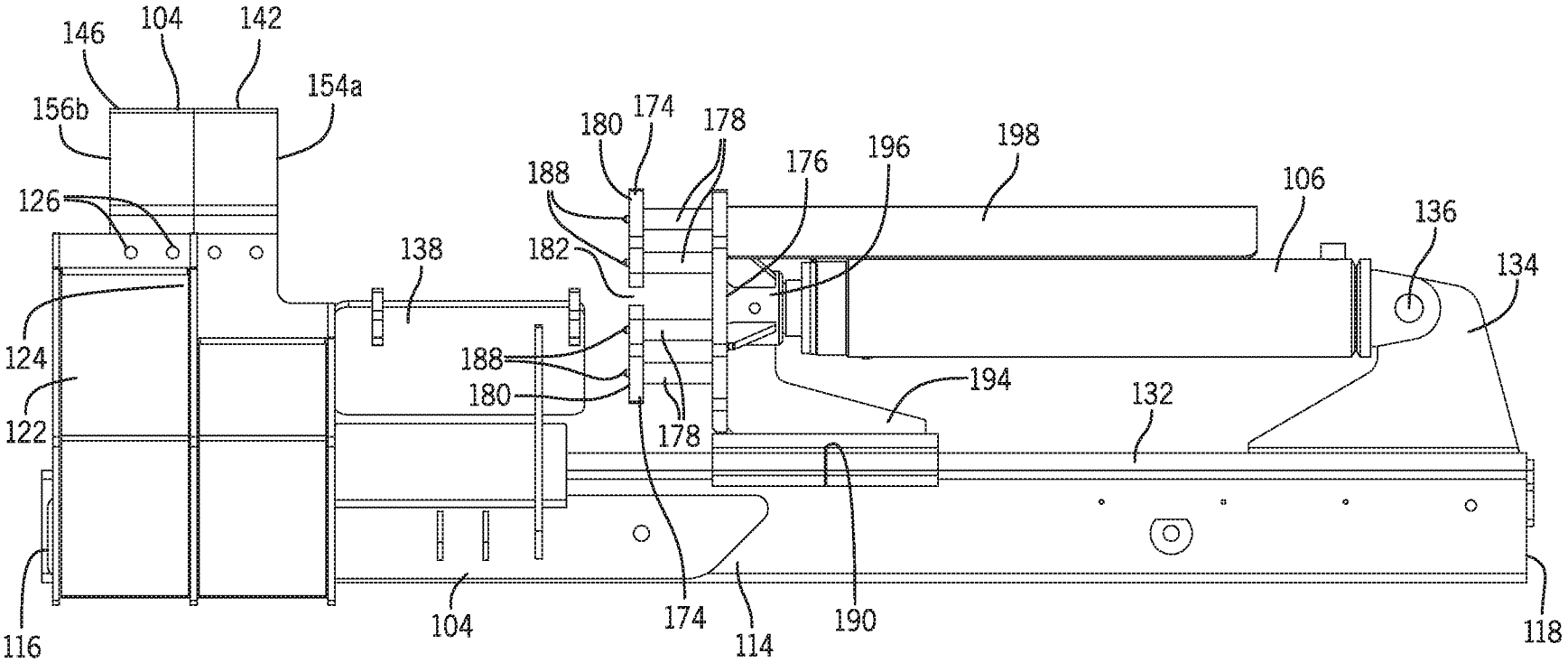
FIG. 2 is a side view of the log splitter of FIG. 1.
Figure 3:
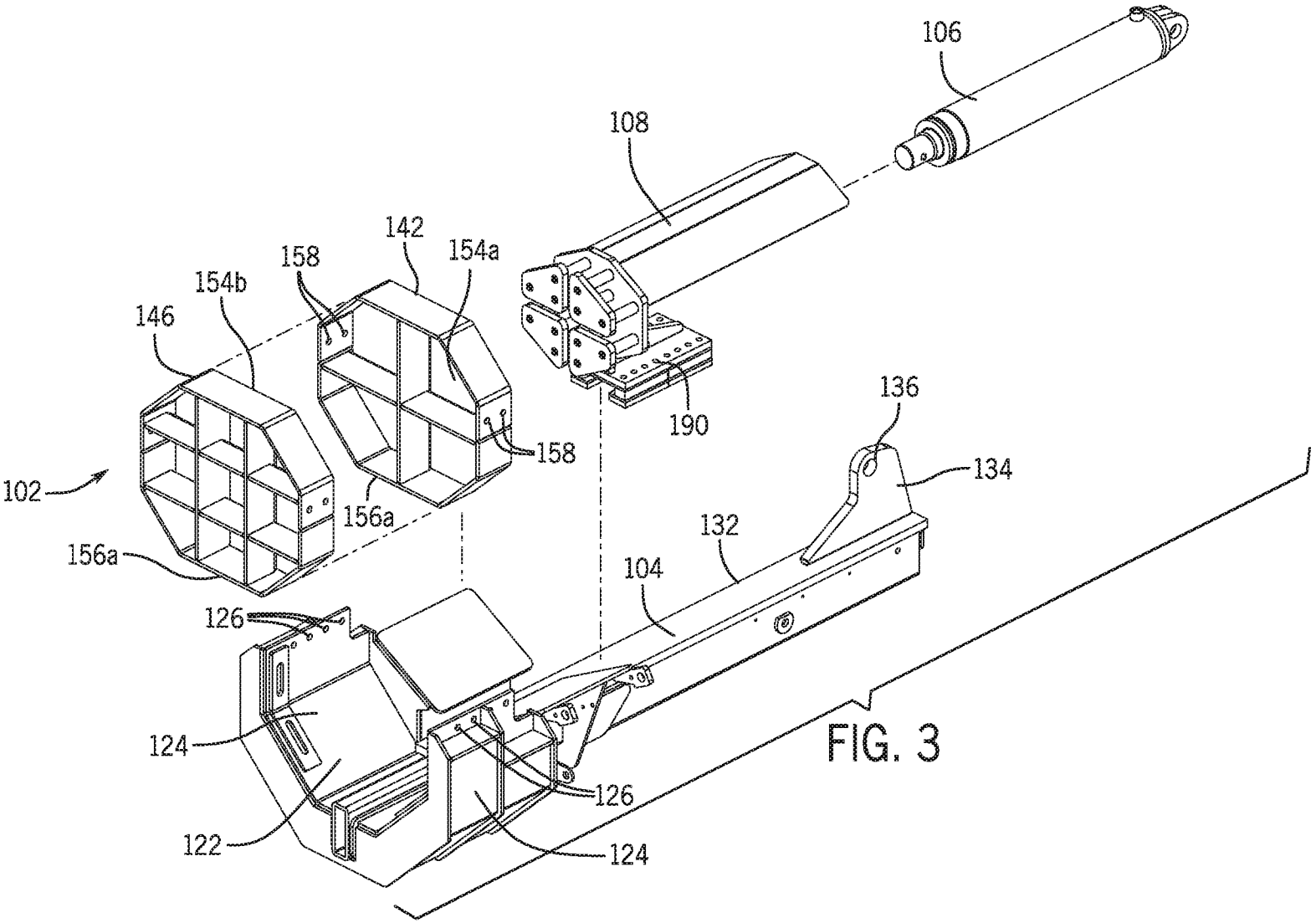
FIG. 3 is an exploded perspective view of the log splitter of FIG. 1.

FIGS. 1-3 an 11-13 illustrate embodiments of a log splitter 100 configured to split a log 80 (see FIG. 13) into a plurality of pieces with a two-stage wedge system. The log splitter 100 includes a wedge assembly 102 with multiple sets of cutting blades that is configured to be secured to one end of a frame 104. An actuator 106 is secured to the opposite end of the frame 104 to move a pusher assembly 108 along the length of the frame 104 between a retracted and extended position. In the illustrated embodiments, the actuator 106 is a pneumatically actuated piston. Some alternative embodiments may alternatively include an actuator configured as at least one of a hydraulic actuator, an electronic actuator, and any other type of linear or non-linear actuator. As it moves into the extended position, the pusher assembly 108 is configured to push a log 80 into the wedge assembly 102, splitting the log 80 into a first set of pieces with a first set of blades before subdividing each of those pieces into smaller log sections with a second set of blades.

Embodiments of the pusher assembly 108 may include a plurality of push pads 174 configured to make contact with and apply the pushing force onto the log 80. As the pusher assembly 108 moves into the extended position, the push pads 174 may enter into the wedge assembly 102 in order to force the log 80 completely through the wedge assembly 102. A support structure can be configured to rigidly support the push pads 174 while also allowing debris created during the splitting process to fall out of the pusher assembly 108 to prevent a jam from forming.

Figure 4:
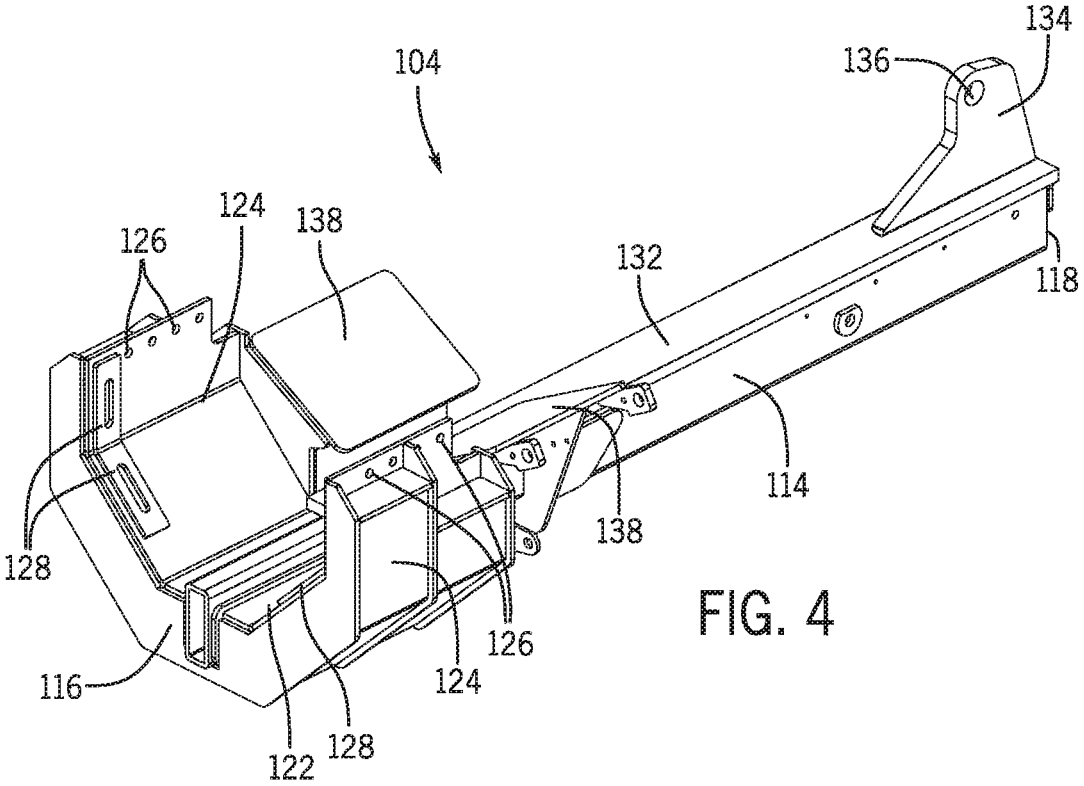
FIG. 4 is a front perspective view of a frame for the log splitter of FIG. 1.
Figure 5:
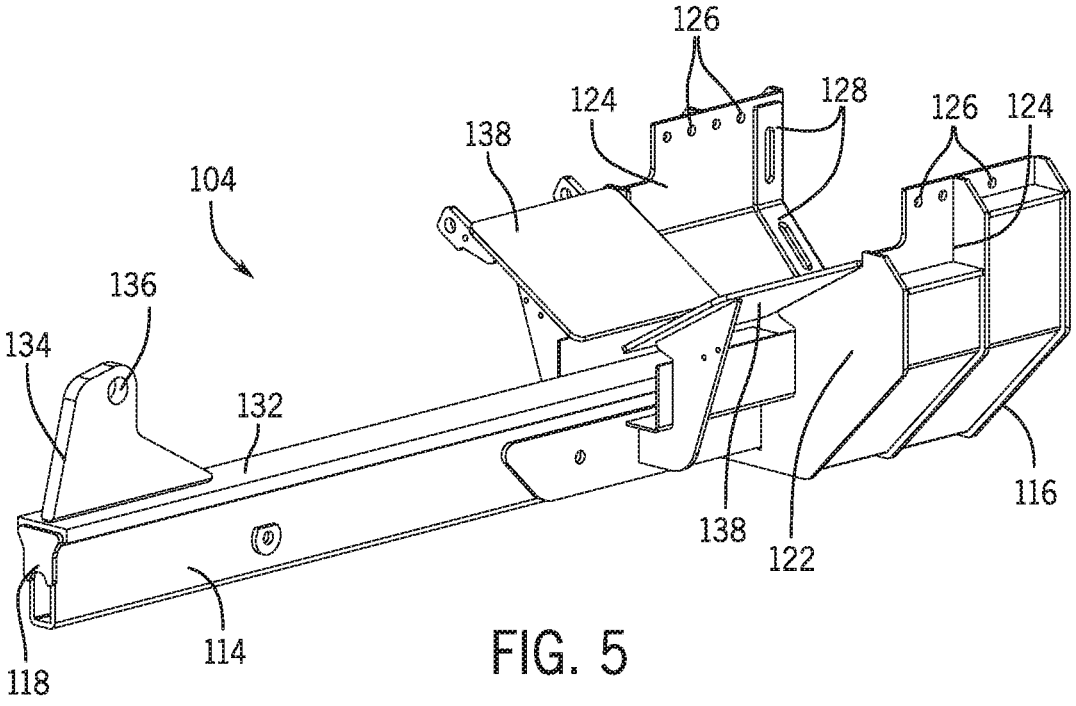
FIG. 5. is a rear perspective view of the frame of FIG. 4.

Having generally described features of log splitter 100, the details of its components and their structure and features will now be discussed. Referring to FIGS. 4 and 5, the frame 104 can include a spine 114 that extends linearly between a front end 118 and a back end 116 of the log splitter 100. A wedge bracket 122 is positioned proximate the front end 118 and includes left and right side walls 124 that extend upward and laterally-outward from the sides of the spine 114. The side walls 124 may be configured to receive the wedge assembly 102, and may include mounting features for securing the wedge assembly 102 to the frame 104. In the illustrated embodiments, for example, each side wall 124 includes two panels arranged to conform to the surfaces of the wedge assembly 102, and mounting openings 126 formed through the side walls 124 are configured to receive a fastener (not shown) to couple the wedge assembly 102 to the side walls 124. Stop members 128 may be positioned on the side walls 124 proximate the front end 118 and can be configured to restrict axial movement of the wedge assembly 102 towards the back end 116 of the frame 104.

Some embodiments of a frame include a support member configured to support the pusher assembly 108. The illustrated frame 104 in FIGS. 4 and 5, for example, may include a slider support 132 that is positioned on a top surface of the spine 114 and extending backwardly from the front end 118 of the frame 104 to the wedge bracket 122. Proximate the front end 118, an actuator attachment member 134 extends upwardly from the slider support 132. An attachment opening 136 formed through the actuator attachment member 134 is configured to be engaged by a fastener (not shown) to secure the actuator 106 to the frame 104.

Figure 13:
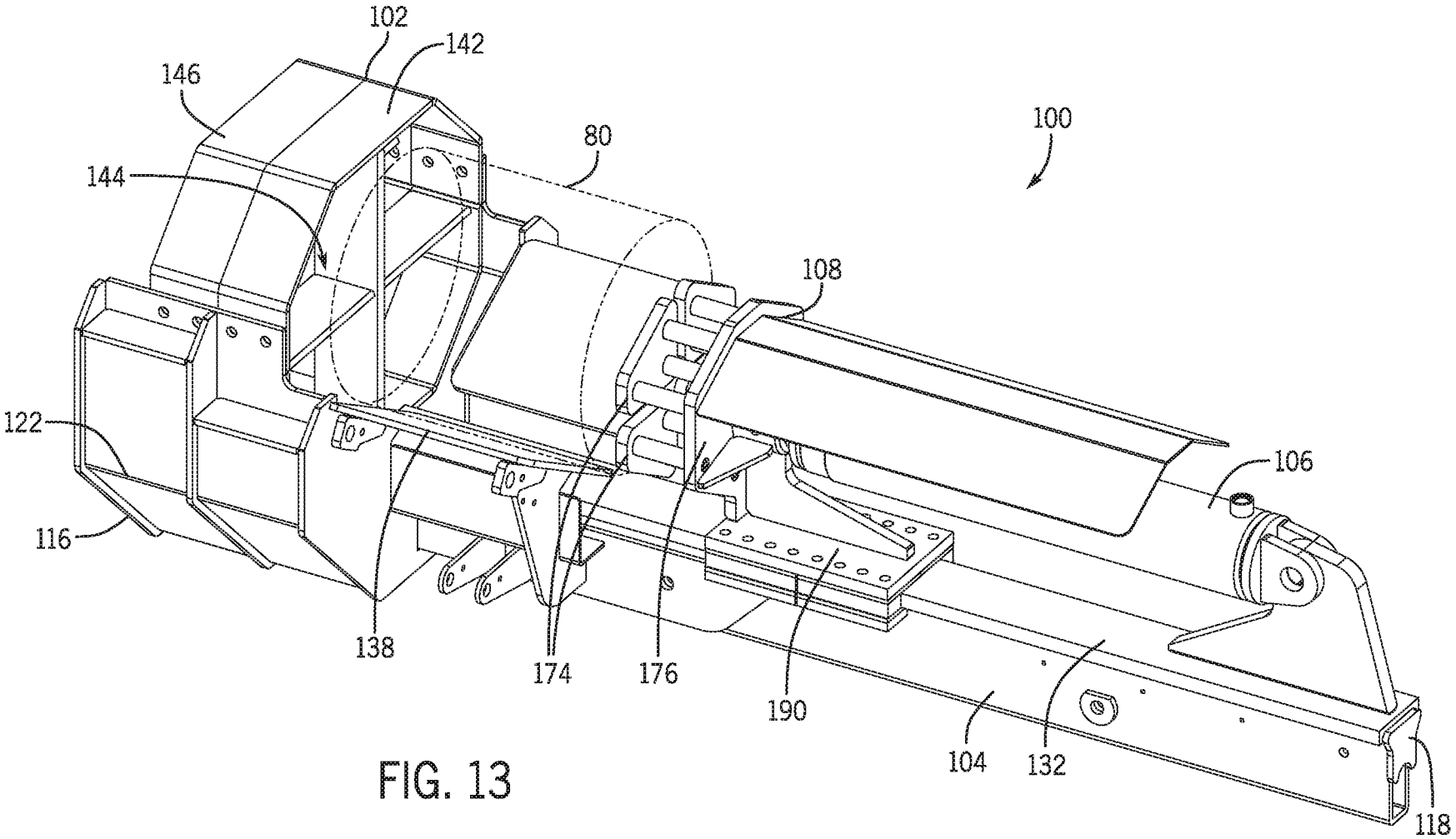
FIG. 13 is a perspective view of the log splitter of FIG. 12 with a log.

Embodiments of a frame can include a log segment support member 138 positioned between the wedge assembly 102 and the back end 116 of the frame 104 to position the log segment for splitting. As illustrated in FIG. 13, for example, the frame 104 can include two log support members 138 secured to opposite lateral sides of the spine 114. Each log support member 138 includes an angled plate on which the log 80 may rest. The log support members 138 are configured to support a log 80 on the frame 104 so that it is in alignment with the wedge assembly 102 before the splitting operation begins.

Figure 6:
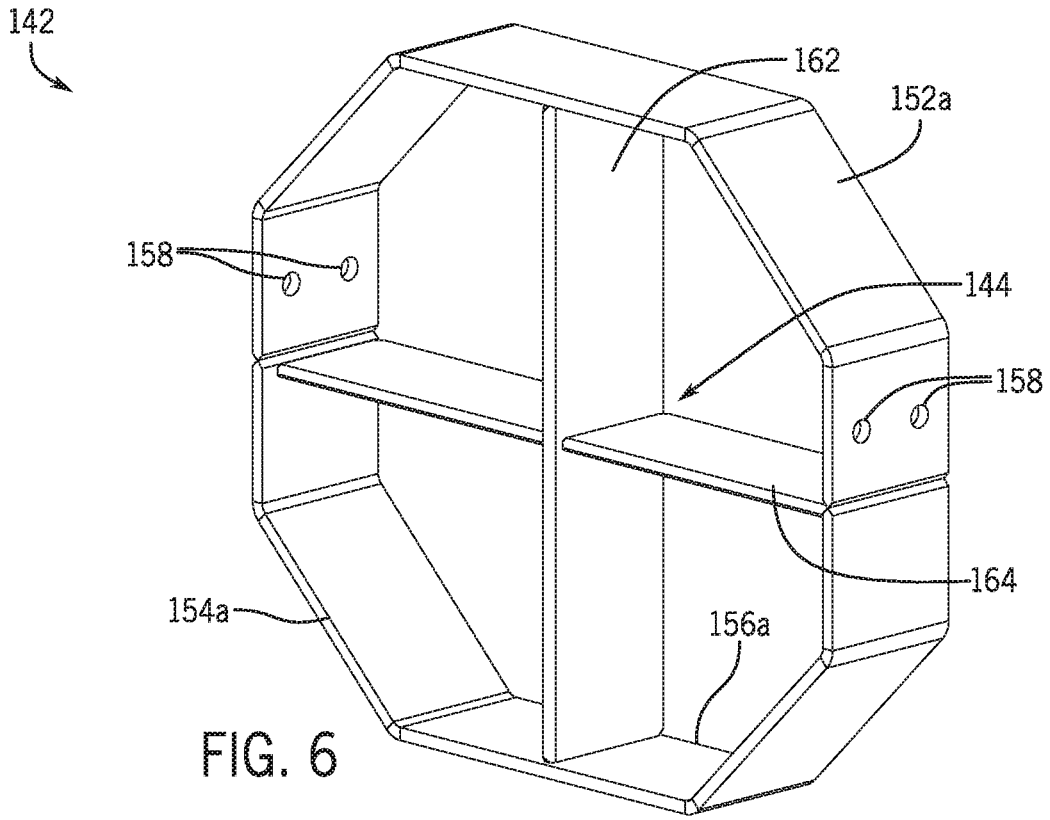
FIG. 6 is a perspective view of a first wedge assembly for the log splitter of FIG. 1.

Some embodiments of a wedge assembly 102 can include multiple wedge boxes e.g. 142, 146 that each have a set of cutting blades e.g. 144, 148. In the illustrated embodiments, for example, the wedge assembly 102 includes a first wedge box 142 with a first blade set 144 and a second wedge box 146 with a second blade set 148. As illustrated in FIGS. 6 and 7, the first wedge box 142 and the second wedge box 146 each include a peripheral wall 152*a*, 152*b* that is generally octagonal and defines a passageway between an entrance opening 154*a*, 154*b* and a discharge opening 156*a*, 156*b*. Mounting openings 158 are formed through the peripheral walls 152*a*, 152*b* on the sides of each of the wedge boxes 142, 146, and can be used to secure the wedge boxes 142, 146 to the wedge bracket 122 of the frame 104. A fastener, such as a bolt, a screw, a pin of any other type of fastener, may be used to simultaneously engage one of the mounting openings 156 on a wedge box 142, 146 and a corresponding one of the openings 126 formed in the wedge bracket 122 to secure the wedge box 142, 146 thereto.

When the wedge assembly 102 is secured to the frame 104, the first wedge box 142 and the second wedge box 146 are configured to provide a continuous passageway from the entrance opening 154*a* of the first wedge box 142 to the discharge opening 156*b* of the second wedge box 146. As illustrated in FIGS. 1 and 2, the first wedge box 142 is configured to be received in the wedge bracket 122 proximate a front end thereof with the entrance opening 154*a* of the first wedge box 142 facing the back end 116 of the frame 104. The second wedge box 146 is configured to be received directly behind the first wedge box 142 so that the entrance opening 154*b* of the second wedge box 146 is in abutment with the discharge opening 156*b* of the first wedge box 142. The stop members 128 on the wedge bracket 122 may be in abutment with the rear edge of the peripheral wall 152*b* and can inhibit movement of the wedge boxes 142, 146 towards the back end 116 of the log splitter 100.

In the illustrated embodiments, the first and second wedge boxes 142, 146 are generally octagonal in shape and equal in size. In some embodiments, however, at least one of the wedge boxes may be different. For example, a wedge assembly can be configured with a first wedge box and a second wedge box that are rectangular. Some embodiments can include a first wedge box that is octagonal and a second wedge box with a circular perimeter wall that is larger than the first wedge box. Further, for embodiments of a log splitter that include a wedge box that is shaped differently than those illustrated, the frame can be configured with a wedge bracket shaped to conform to the shape of the perimeter wall of that wedge box. Other embodiments where the wedge boxes may have different shapes are intended to be within the scope of the present application.

Referring to FIG. 6, the first blade set 144 is secured to the peripheral wall 152*a* of the first wedge box 142. The first blade set 144 may be configured to divide the passageway though the first wedge box into a set of first sections. In the illustrated embodiments, the first blade set 144 includes a primary, vertical blade 162 and a primary, horizontal blade 164 in a perpendicular orientation, resulting in four first sections. The vertical blade 162 can be positioned proximate the vertical centerline of the open passageway, and the primary horizontal blade 164 can be positioned proximate the horizontal centerline of the passageway of first wedge box 142. Each blade 162, 164 of the first blade set 144 has a sharpened edge facing the entrance opening 154*a* of the first wedge box 142 for penetrating an incoming log 80. In some embodiments, the cutting edge of the primary horizontal blade can be offset from the cutting edge of the primary vertical blade. For example, the cutting edge of the illustrated vertical blade 162 is positioned proximate the entrance opening 154*a* of the first wedge box 142, while the horizontal blade 164 is offset toward the discharge opening 156*a*. This may be useful for reducing the force required to advance a log 80 into the first wedge box 142. Some embodiments can include a first blade set configured so that the offset between the primary blades is reversed and the cutting edge of the horizontal blade is positioned in front of the cutting edge of the vertical blade.

Figure 7:
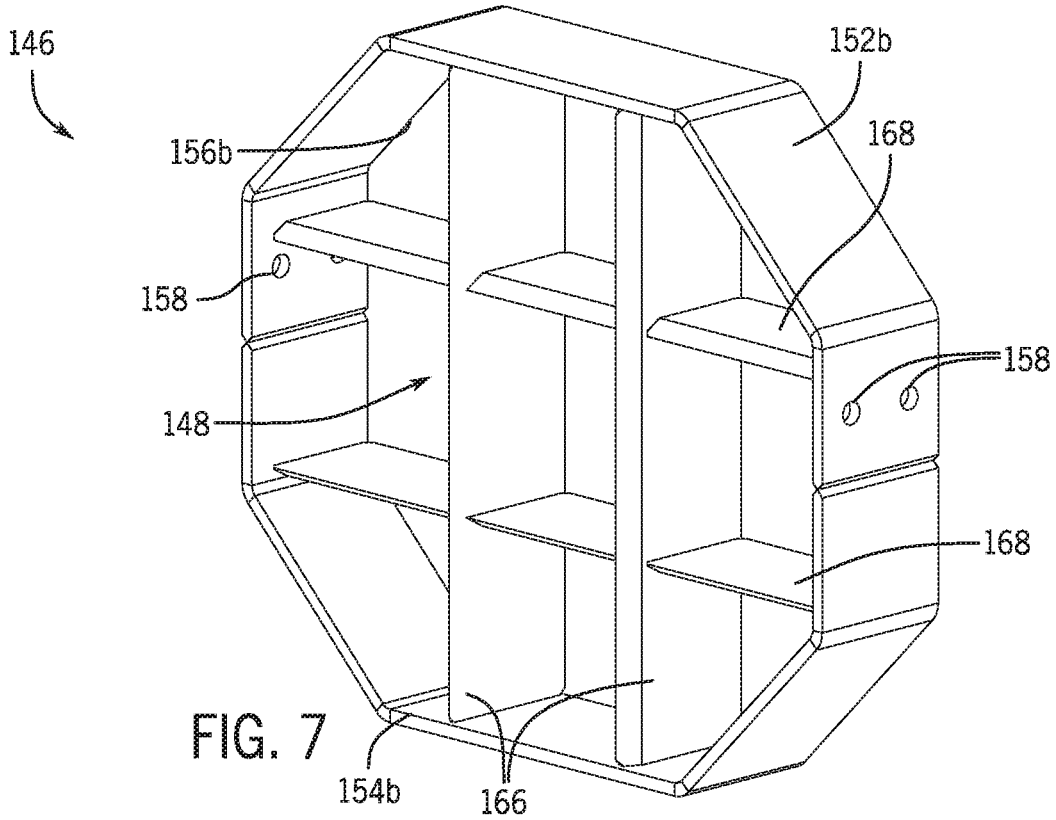
FIG. 7 is a perspective view of a second wedge assembly for the log splitter of FIG. 1.
Figure 8:
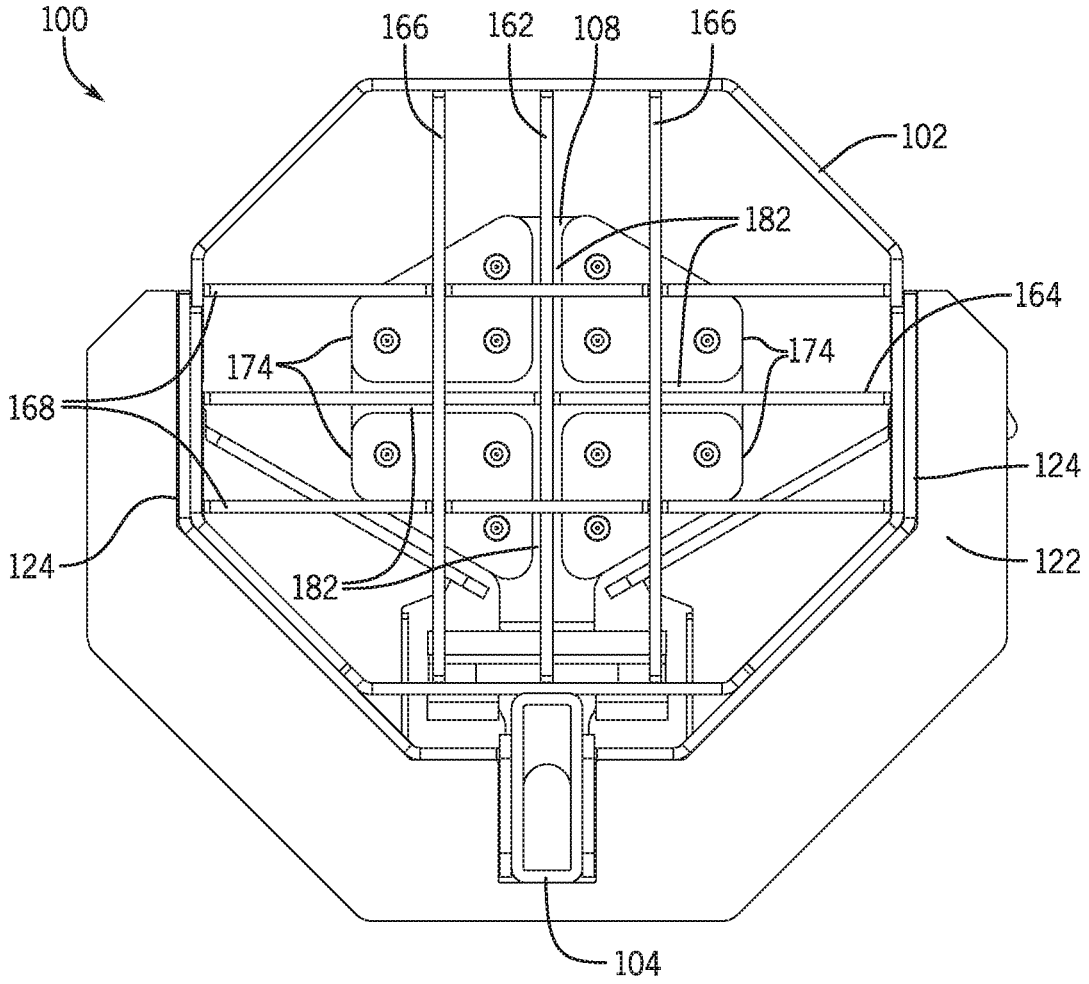
FIG. 8 is a front view of the log splitter of FIG. 1.

Referring to FIG. 7, the second blade set 148 is secured to the peripheral wall 152*b* of the second wedge box 146. The second blade set 148 may be configured to divide each of the first sections provided by the first blade set 144 into at least two second sections when the first wedge box 142 and the second wedge box 146 are secured to the frame 104. In the illustrated embodiments, the second blade set 148 includes a pair of secondary, vertical blades 166 and a pair of secondary, horizontal blades 168, with the secondary vertical blades 166 in a perpendicular orientation to the secondary horizontal blades 168. As illustrated in FIG. 8, the blades 166, 168 of the second blade set 148 are positioned such that each first section produced by the first blade set 144 is intersected by one secondary vertical blade 166 and one secondary horizontal blade 168. Thus, each first section is divided into four, second sections, with a total of sixteen second sections formed.

Each of the blades 166, 168 of the second blade set 148 has a cutting edge that faces the entrance opening 154*b* of the second wedge box 146 for penetrating an incoming log segment. Similarly to the first blade set 144, the cutting edges of the secondary vertical blades 166 are offset relative to the cutting edges of the secondary horizontal blades 168. This may be useful for reducing the force required to advance a log 80 into the second wedge box 146.

In some embodiments, the secondary vertical blades 166 may be inclined toward a vertical centerline of the second wedge box 146 and the secondary horizontal blades 168 can be inclined toward a horizontal centerline of the second wedge box 146. The inclination of the second blade set 148 may be useful, for example, to assist in splitting a log 80 as it passes through the second wedge box 146. In some embodiments, however, at least one of the blades 166, 168 of the second blade set 148 may be configured without any inclination. Additionally or alternatively, the cutting edge of the secondary vertical blades 166 may include a single beveled surface oriented away from a vertical centerline of the passageway of the second wedge box 146, and the cutting edge of the secondary horizontal blades 168 may include a single beveled surface oriented away from a horizontal centerline of the passageway. The single bevel of the cutting edge of the second blade set 147 may be useful, for example, to assist in splitting a log as it passes through the second wedge box 146. In some embodiments, at least one of the blades 166, 168 of the second blade set 148 may include a cutting edge with a different bevel configuration.

In the illustrated embodiments, the log splitter 100 is includes a wedge assembly 102 configured to split a log 80 into sixteen separate log sections. Some embodiments, however, may be configured to create a different number of sections. For example, a wedge assembly may include a first wedge box configured to split a log into two log sections and a second wedge box configured to further split each of those section into two smaller section, resulting in a total of four log sections. Another embodiment may include a first wedge box configured to split a log into six log sections and a second wedge box configured to further split each of those section into three smaller sections, resulting in a total of eighteen log sections. Additionally or alternatively, a wedge assembly may be configured to split a log into equally-sized sections, or at least one split log section may be large or smaller than another log section. Many alternative section configurations will be recognized by one of ordinary skill in the art, and such configurations are intended to be within the scope of the present application.

In some embodiments, the first wedge box 142 and the second wedge box 146 are selectively removable from the frame 104. After disengaging the fastener from the corresponding mounting openings 126, 158 on the wedge box 142, 146 and the frame, the wedge boxes 142, 146 maybe removed. This may be useful, for example, for at least one of unjamming, cleaning, blade sharpening, maintenance, and any other purpose. Additionally or alternatively, a wedge assembly maybe configurable with multiple sets of corresponding first and second wedge boxes 142, 146. For example, a wedge assembly can include plurality of different first and second wedge boxes configured to be used in various different combinations to produce different numbers and sizes of split log sections. Some embodiments can include a wedge assembly with only one wedge box, or with more than two wedge boxes.

Figure 9:
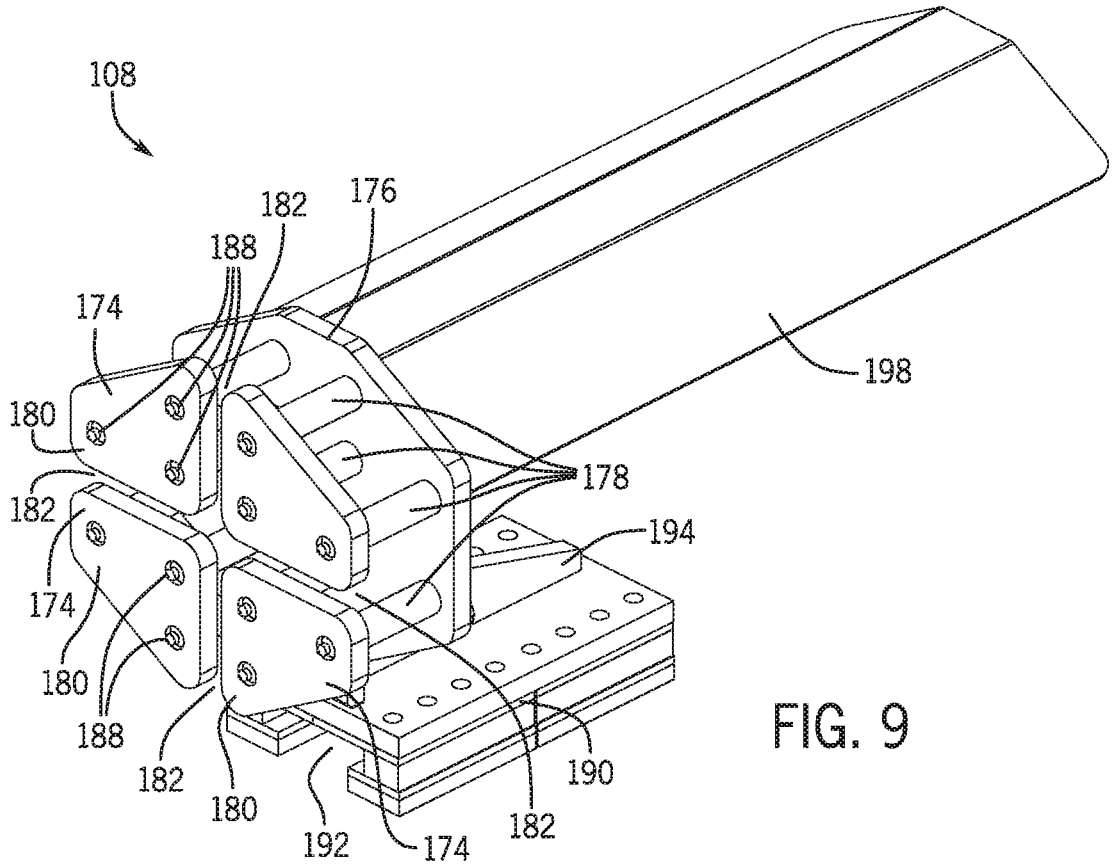
FIG. 9 is a front perspective view of a pusher assembly for the log splitter of FIG. 1.
Figure 10:
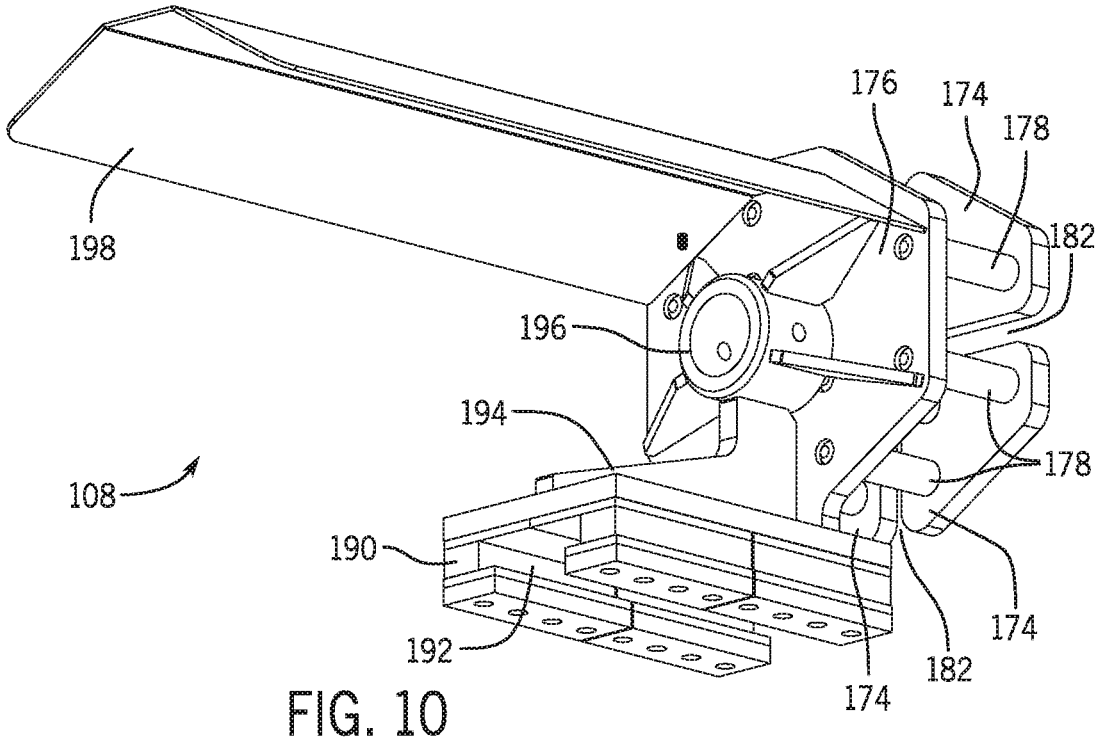
FIG. 10 is a rear perspective view of the pusher assembly of FIG. 9.

With continued reference to the figures, a pusher assembly 108 can include supports 176, 178, 190 and a plurality of push pads 174 configured to make contact push a log 80 into the wedge assembly 102. For example, as illustrated in FIGS. 9 and 10, the pusher assembly 108 may include four push pads 174 that are supported on a base 176 by a plurality of support columns 178, and a support glide 190 may be secured to a bottom side of the base 176. The support glide 190 includes a channel 192 configured to slidably engage the slider support 132 of the frame 104. A gusset plate 194 links the support glide 190 and the base 176 to a bushing 196 that extends from a back side of the base 176. The bushing 196 is configured to receive a portion of the actuator 106, thereby linking the pusher assembly 108 to the actuator attachment member 134 of the frame 104 via the actuator 106. The pusher assembly 108 may additionally include a shield 198 that is positioned above the bushing 196 and projecting outwardly from the base 176. The shield 198 may be configured to prevent damage to the actuator 106 resulting from incidental contact between the actuator 106 and a log. In some embodiments, the pusher assembly is configured to be supported on the frame with an alternative support arrangement. For example, the pusher assembly may include a support configured to slide along at least one rail formed along the length of the frame, or the support can be configured to slide on the spine of the frame. Additionally or alternatively, some embodiments, may include a pusher support and a frame configured with a rolling interface. Further still, some embodiments may include a pusher assembly that is supported by the actuator alone.

In the illustrated embodiments, the push pads 174 are spaced apart from a front side of the base 176 so that the contact surfaces 180 of the push pads 174 are generally coplanar with each other. The four push pads 174 are arranged in a two-by-two grid with a gap 182 between each adjacent push pad 174. As illustrated in FIG. 8, the gaps 182 may be configured to be in alignment with the blades 162, 164 of the first blade set 144 when the pusher assembly 108 and the wedge assembly 102 are received on the frame 104. This may be useful, for example, so that the blades 162, 164 of the first blade set 144 can be received between the push pads 174 as the pusher assembly 108 pushes a log 80 through the wedge assembly 102.

In the illustrated embodiments, the support columns 178 are generally cylindrical and each extend from a first end received in an opening 184 formed in the base to a second end received in an opening 186 formed through one of the push pads 174. The support columns 178 may be secured to the base 176 and the push pads 174 through at least one of a threaded connection, a mechanical fastener, adhesive, a welded connection and any other method for attachment. The second ends of the support columns 178 may include tines 188 that extend though the opening 186 past the contact surfaces 180 of the push pads 174. The tines 188 are configured to engage the surface of log 80 as it is pushed into the wedge assembly 102. This may be useful, for example, in order to retain a log 80 in position as the log 80 is pushed through the wedge assembly 102. In some embodiments, at least one of the tines may be formed on a different part of the pusher assembly. For example, a tine may be formed on or secured to at least one of a push pad or the base.

Some embodiments of a push pad can be supported by a plurality of supports. In the illustrated embodiments, for example, each of the push pads 174 is supported by three support columns 178 positioned proximate the interior edges of the push pad 174. At least one of the dimensions of the support columns 178 and the position of each support column 178 may be selected to provide sufficient clearance between the base 176 and the back side of the push pads 174 for wood splinters or pieces, debris, or other material to pass between the base 176 and the push pads 174 as a log 80 is split with the log splitter 100. This may be useful, for example, in order to prevent material or debris from becoming stuck in the pusher assembly 108.

Figure 11:
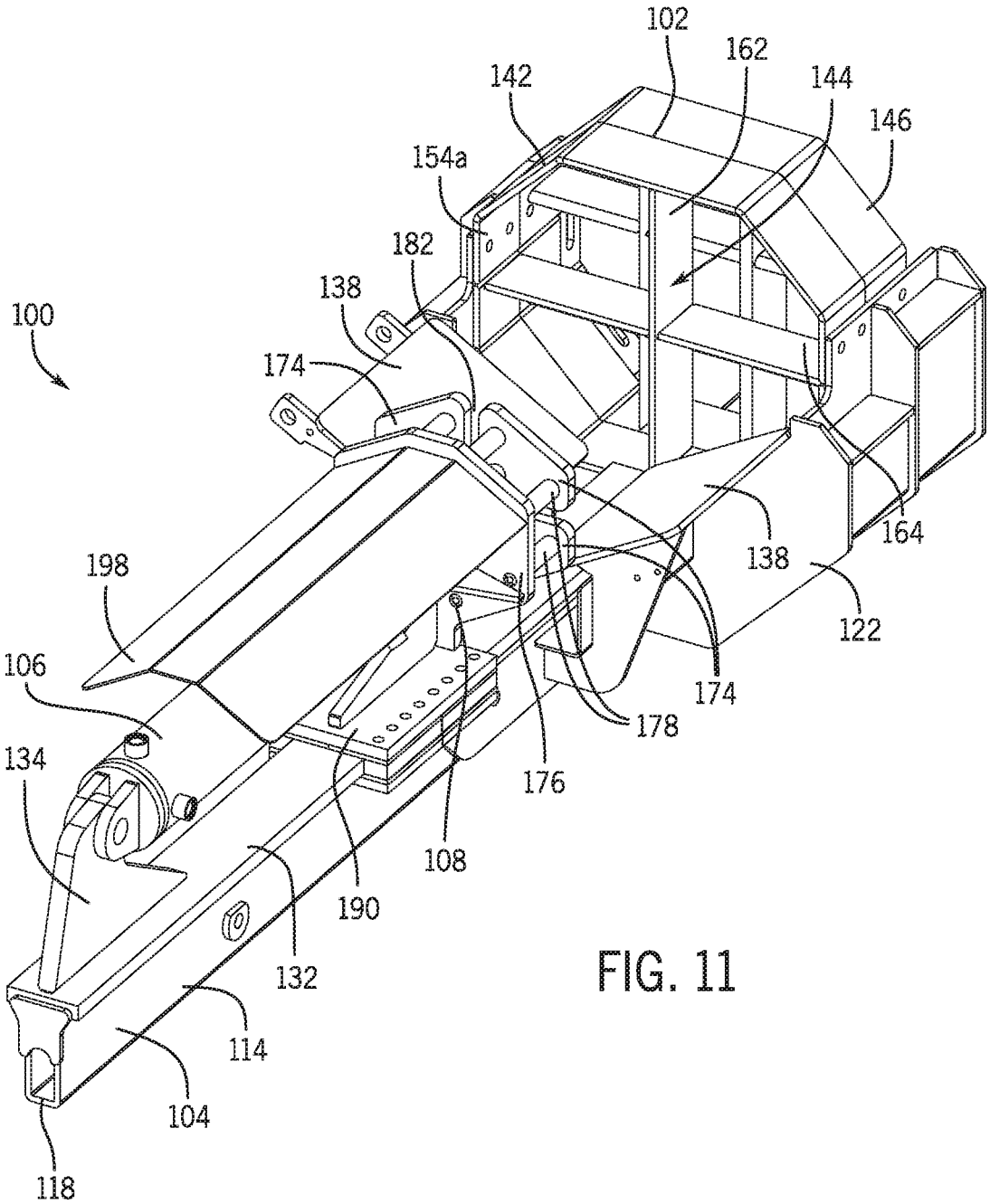
FIG. 11 is a rear perspective view of the log splitter of FIG. 1 with the pusher assembly in a retracted position.
Figure 12:
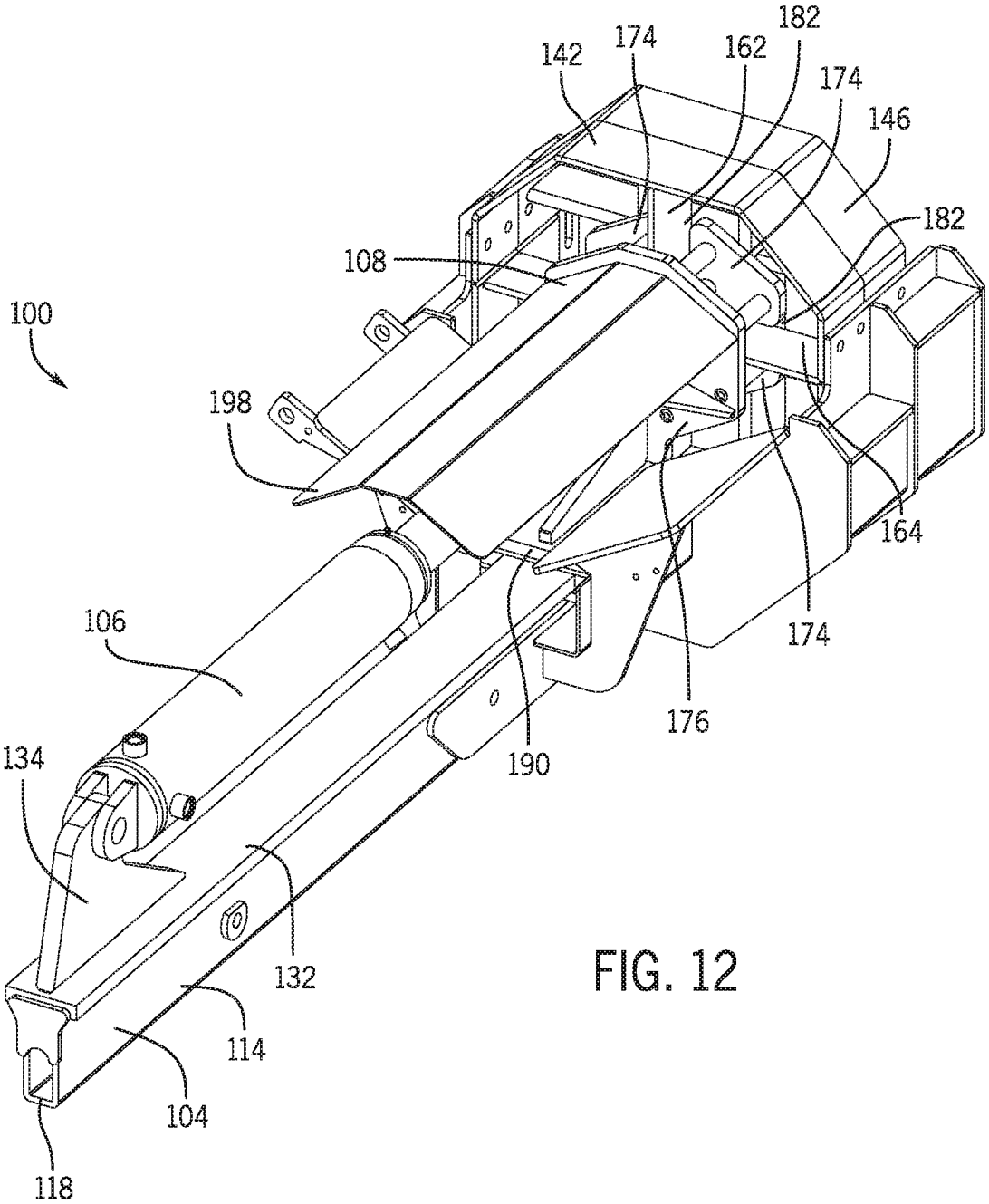
FIG. 12 is a rear perspective view of the log splitter of FIG. 11 with the pusher assembly in an extended position.

The support columns 178 may additionally be configured to allow the push pads 174 to enter into the first wedge box 142 as the pusher assembly 108 moves from the retracted position (FIG. 11) to the extended position (FIG. 12). As the actuator 106 slides the pusher assembly 108 into the extended position, each of the push pads 174 moves through the entrance opening **154*a* into one of the four quadrants defined by the first blade set 144, and the primary blades 162, 164 are received in the gaps 182 between each of the push pads 174. When the actuator 106 is fully extended, the base 176 of the pusher assembly 108 may be positioned near, but not touching, the cutting edges of the first blade set 144. The support columns 178 may have a length dimensioned so that the contact surfaces 180 of the push pads 174 are positioned proximate the discharge opening 156*a* of the first wedge box 142 and in front of the cutting edges of the second blade set 148**. This may be useful, for example, to move a log through both blade sets with a single stage actuator.

In some embodiments, a pusher assembly 108 may be configured with an alternative support structure for supporting the push pads 174. For example, at least one of the push pads may be supported by more than three support columns 178 or fewer than three support columns 178. At least one of the support columns 178 can have a different shape and/or a different size than at least one other support column. For example, a push pad 174 can be supported by two circular columns 178 and two rectangular columns 178. Further, at least one of the support columns 178 can be positioned differently than the illustrated support columns 178. All such permutations are intended to be within the scope of the present application.

To split a log 80 with the log splitter 100, the log 80 may be placed on the log support members 138 so that the log 80 is positioned between the contact surface 180 of the push pads 174 and the entrance opening **154*a* of the first wedge box 142. The actuator 106 may then be controlled to extend to move the pusher assembly 108 from the retracted position to the extended position. As the actuator 106 extends, the support glide 190 slides along the slider support 132 and the pusher assembly 108 moves towards the log 80 and the wedge assembly 102. The contact surface 180 of the push pads 174 and the tines 188 make contact with the log 80, sliding the log 80 towards the wedge assembly 102 on the log support members 138. When the log 80 makes contact with the first blade set 144, the tines are driven into the rear surface of the log 80. Engagement between the tines 188 and the log 80 can retain the log 80 in place and may prevent pieces of the log 80 from separating before moving into the wedge assembly 102**.

As the actuator 106 continues to extend, a pushing force is transmitted from the actuator 106 to the log 80 through the base 176, the support columns 178 and the push pads 174. The pushing force presses the front end of the log 80 into the cutting edges of the primary blades 162, 164, thereby splitting the log 80 into separate log pieces. In this embodiment shown in the Figures, the log 80 would be split into four pieces by the primary blades 162, 164. As noted, different configurations may be used for the primary blades 162, 164 and the push pads 174 such that the log may be split into a different number of pieces. The pusher assembly 108 continues to move forward, further splitting the log 80 along its length and advancing each of the log pieces through the first wedge box 142. As the log pieces move out of the first wedge box 142 and into the second wedge box 146, each of the log pieces makes contact with the second blade set 148 at one of the intersections between a secondary vertical blade 166 and a secondary horizontal blade 168. The push pads 174 continue to apply a pushing force onto the log 80, forcing the log pieces into the cutting edges of the secondary blades 166, 168 to further divide each log piece into smaller sections. In this embodiment shown in the Figures, the four log pieces created by the primary blades 162, 164 would each be split into four smaller pieces by the secondary vertical blade 166 and a secondary horizontal blade 168. Again, different configurations may be used for the secondary vertical blade 166 and a secondary horizontal blade 168 such that the log pieces may be split into a different number of smaller pieces. The pusher assembly 108 continues to slide towards the sedge assembly 102 to push the split log sections out the discharge opening 156*b* of the second wedge box 146.

As the pusher assembly 108 nears the fully extended position, the push pads 174 move into the first wedge box 142 through the entrance opening 154*a* and the first blade set 144 is received in the gaps 182 between push pads 174. As the log 80 is split by the wedge assembly 102, wood splinters and other debris can be formed and may accumulate near the push pads 174 and in the first and second wedge boxes 142, 146. Spacing between the support columns 178 allows material or debris to pass between the base 176 and the push pads 174, thereby preventing the material from filling the gaps 182 and preventing the primary blades 162, 164 from being received between the push pads 174. The pusher assembly 108 can continue to slide along the length of the frame 104 until it reaches the extended position in which the base 176 is positioned proximate the first bade set 144, the push pads 174 are positioned proximate the second blade set 148, and the log 80 has been completely split by the second blade set 148.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pusher assembly for a log splitter including a frame, an actuator, and a wedge assembly with a first set of cutting blades and a second set of cutting blades configured to split a log into a plurality of pieces, the pusher assembly comprising:

a base configured to be coupled to the actuator;

a plurality of push pads spaced apart from the base, each push pad including a contact surface that is coplanar with the contact surfaces of the other push pads;

a plurality of support columns extending between each one of the plurality push pads and the base;

wherein the plurality of push pads are configured to receive the first set of cutting blades in gaps positioned between adjacent push pads as the plurality of push pads forces the log through the wedge assembly; and wherein each of the support columns includes a tine that extends through an opening formed through one of the plurality of push pads past the contact surface thereof, each of the tines beings configured to engage the log.

2. The pusher assembly of claim 1, wherein the plurality of push pads includes four push pads arranged in a two-by-two grid.

3. The pusher assembly of claim 2, wherein the plurality of support columns are arranged along interior edges of the push pads that extend along the gaps positioned between adjacent push pads.

4. The pusher assembly of claim 1, wherein the plurality of push pads are substantially identical to each other.

5. The pusher assembly of claim 1, wherein the plurality of support columns includes three support columns extending between each one of the push pads and the base.

6. The pusher assembly of claim 1, further comprising a support slide secured to the base and configured to slidably engage the frame to support the pusher assembly as it is moved by the actuator from a retracted position to an extended position to force the log through the wedge assembly.

7. The pusher assembly of claim 1, further comprising a bushing configured to receive an end of the actuator to couple the base thereto.

8. The pusher assembly of claim 7, further comprising a shield projecting outward from the base above the bushing, the shield being configured to protect the actuator for damage.

9. A log splitter configured to split a log into a plurality of log pieces, the log splitter comprising:

a frame;

a wedge assembly positioned at a first end of the frame, the wedge assembly including a first set of cutting blades and a second set of cutting blades positioned behind the first set of blades;

a pusher assembly linked to a second end of the frame opposite the first end and moveable between a retracted position and an extended position, the pusher assembly including a plurality of push pads, each one of the push pads supported by a plurality of support columns;

wherein the plurality of push pads are configured to push the log through the wedge assembly as the pusher assembly moves into the extended position, and the plurality of push pads are configured to be received in the wedge assembly between the first set of cutting blades as the log is pushed through the wedge assembly; and wherein each of the support columns includes a tine that extends through an opening formed through one of the plurality of push pads past a contact surface of said push pad, each of the tines beings configured to engage the log.

10. The log splitter of claim 9, wherein the wedge assembly includes a first wedge box with the first set of cutting blades and a second wedge box including the second set of cutting blades; and wherein the frame includes a wedge bracket configured to receive the first wedge box and the second wedge box.

11. The logs splitter of claim 9, wherein the first set of cutting blades is configured to divide a passageway through the wedge assembly into a plurality of first sections, and the second set of cutting blades is configured to divide each one of the first sections into a plurality of second sections.

12. The logs splitter of claim 9, wherein the pusher assembly includes gaps positioned between each of the plurality of push pads, and the gaps are configured to receive the first set of cutting blades as the plurality of push pads move into the wedge assembly.

13. The log splitter of claim 12, wherein the first set of cutting blades includes a vertical blade and a horizontal blade arranged perpendicularly to the vertical blade, the vertical blade and horizontal blade intersecting to define four quadrants; and wherein the plurality of push pads includes four push pads, each one configured to be received in one of the four quadrants.

14. The log splitter of claim 9, wherein each plurality of support columns is configured to provide a space between one of the push pads and a base of the pusher assembly.

15. The log splitter of claim 14, wherein each plurality of support columns includes three support columns extending between one of the push pads and the base of the pusher assembly.

16. The log splitter of claim 9, wherein the pusher assembly includes a support slide configured to slidably engage the frame to support the pusher assembly as it is moves from the retracted position to the extended position.

17. The log splitter of claim 9, wherein the first set of cutting blades is configured to split the log into multiple log pieces and the second set of cutting blades is configured subdivide each of the log pieces into a plurality of smaller log pieces.

18. The pusher assembly of claim 1, wherein the columns in each plurality of columns are spaced apart from each other so that debris from the log can pass between the base and each one of the push pads.

19. The log splitter according to claim 9, wherein the columns in each plurality of support columns are arranged so that debris from the log can pass between the plurality of columns supporting each of the push pads in the space between the base and each one of the push pads.

* * * * *